US006485342B2

(12) United States Patent
Tsubouchi et al.

(10) Patent No.: US 6,485,342 B2
(45) Date of Patent: Nov. 26, 2002

(54) OUTBOARD MOTOR

(75) Inventors: Masanori Tsubouchi, Wako (JP); Tomonori Ikuma, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/931,723

(22) Filed: Aug. 17, 2001

(65) Prior Publication Data

US 2002/0025741 A1 Feb. 28, 2002

(30) Foreign Application Priority Data

Aug. 25, 2000 (JP) ..... 2000-255413

(51) Int. Cl.[7] ..... B63H 21/10
(52) U.S. Cl. ..... 440/88; 440/900
(58) Field of Search ..... 440/88, 89, 900

(56) References Cited

U.S. PATENT DOCUMENTS 6,149,477 A * 11/2000 Toyama ..... 123/516

FOREIGN PATENT DOCUMENTS

JP 08310487 11/1996

* cited by examiner

*Primary Examiner*—Jesus D. Sotelo
(74) *Attorney, Agent, or Firm*—Adams & Wilks

(57) ABSTRACT

An outboard motor is provided, the motor including a V-multicylinder engine arranged horizontally and an intake silencer arranged above the engine. The V engine has an engine block including cylinder blocks extending in a V configuration, forming an opening to the rear of the outboard motor. The intake silencer is arranged above the engine block to match the shape of the V engine. The intake silencer has two inlets opening rearwards of the outboard motor and one outlet positioned between the inlets for introducing air to combustion chambers of the cylinder heads. The two inlets are positioned above the cylinder blocks in a V configuration, respectively.

20 Claims, 5 Drawing Sheets

OUTBOARD MOTOR

BACKGROUND OF THE INVENTION

1. Field of the Invention

The present invention relates to an improved outboard motor with an intake silencer.

2. Description of the Related Art

Intake noise caused by outboard motors without intake silencers or outboard motors with intake openings directed to the hulls to which they are mounted, is transmitted directly to operators. To prevent it, outboard motors have been provided with intake silencers in the passage of intake air to reduce intake noise. An outboard motor with such an intake silencer is disclosed, for example, in Japanese Patent Laid-Open Publication No. HEI-8-310487.

This outboard motor has an intake silencer interposed in the induction system of an engine. The induction system has a throttle body arranged in the laterally and generally middle part in the front portion of an engine room in the outboard motor, and takes air in from both right and left sides of the throttle body. Thus the total cross-sectional area of two intake openings of the intake silencer is greater than the cross-sectional area of the intake air passage of the throttle body, securing a sufficient amount of intake air.

The above conventional intake silencer is arranged to face the hull (in the front portion of the outboard motor in the advancing direction), and the intake openings face upwards in the vertical direction, so that intake noise is directly transmitted to an operator, resulting in an unsatisfactory endeavor in the reduction of intake noise.

SUMMARY OF THE INVENTION

The present invention was made with the above points in mind and it is accordingly an object of the present invention to provide a V-engine-mounted outboard motor in which intake noise is prevented from being directly transmitted to an operator without making the outboard motor larger.

According to the present invention, there is provided an outboard motor comprising: a V engine arranged in a horizontal direction, the engine comprising: an engine block comprising two cylinder blocks extending in a V configuration, forming an opening to the rear of the outboard motor, and a skirt integrally formed with the cylinder blocks and housing a crankshaft arranged vertically; and two cylinder heads having a plurality of combustion chambers, being provided at the rear ends of the cylinder blocks; and an intake silencer comprising: two inlets positioned above the cylinder heads and opening rearwards of the outboard motor for taking air in; and one outlet positioned between the two inlets for letting the inlet air out to supply it to the combustion chambers.

Thus in the present invention, the V configuration of the V engine mounted to the outboard motor is utilized to sufficiently secure the volume of an expansion chamber and the opening of the intake silencer while making the lateral dimension of the intake silencer smaller than that of the opening end of the V configuration. The two inlets open rearwards of the outboard motor so as to prevent intake noise from being directly transmitted to an operator, thereby increasing the noise dampening effect of the intake silencer. Further, since upper space of the engine block is utilized to arrange the intake silencer therein, the dimension of the outboard motor in the back and forth direction is made smaller, making the outboard motor compact. Furthermore, since the two inlets are provided, a cross-sectional area of each inlet is made smaller, saving space.

The outboard motor further comprises a transmission system for transmitting drive force from the crankshaft to a camshaft for opening or closing intake valves and exhaust valves provided in the combustion chambers, the transmission system being provided between the engine block and the intake silencer.

Thus, since the intake silencer is arranged above the transmission system provided above the engine block, space above the transmission system is usable, making the outboard motor compact.

It is preferred that a throttle body connected to the outlet of the intake silencer be arranged between the cylinder heads extending in a V configuration above the camshaft of the transmission system so that space is efficiently utilized without waste. The outlet of the intake silencer is connected to the throttle body via a grommet in an embodiment, for example.

In the present invention, the intake silencer has a body with a top wall configured flat. Thus the height of the intake silencer is made smaller, resulting in the smaller height of the outboard motor.

BRIEF DESCRIPTION OF THE DRAWINGS

Preferred embodiments of the present invention will be described below, by way of example only, with reference to the accompanying drawings, in which.

DETAILED DESCRIPTION OF THE PREFERRED EMBODIMENTS

Figure 1:
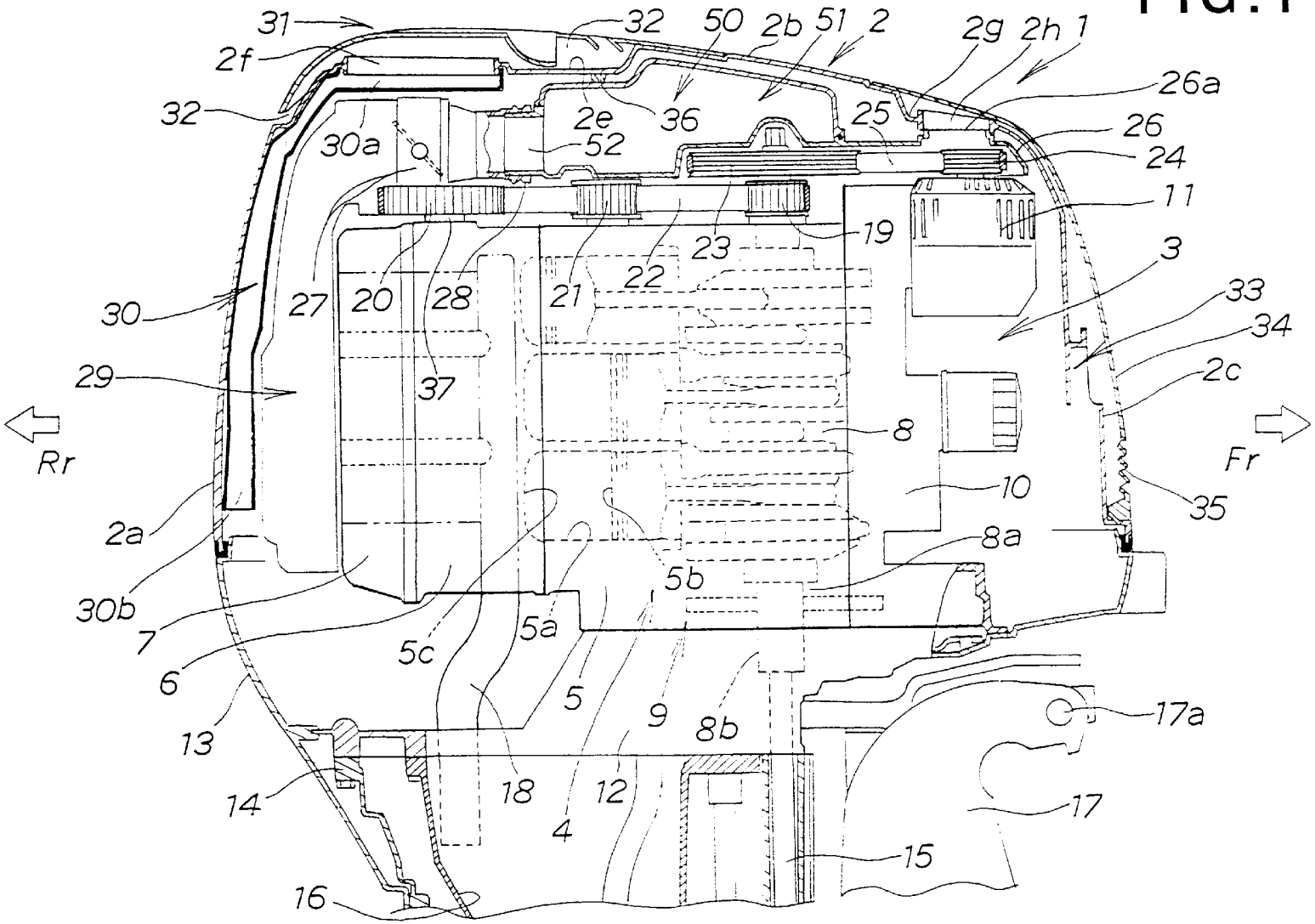
FIG. 1 is a partly sectional view of an outboard motor according to the present invention.

In an embodiment as shown in the drawings, Fr denotes a forward direction as an advancing direction of the ship and Rr denotes a rearward direction.

Figure 3:
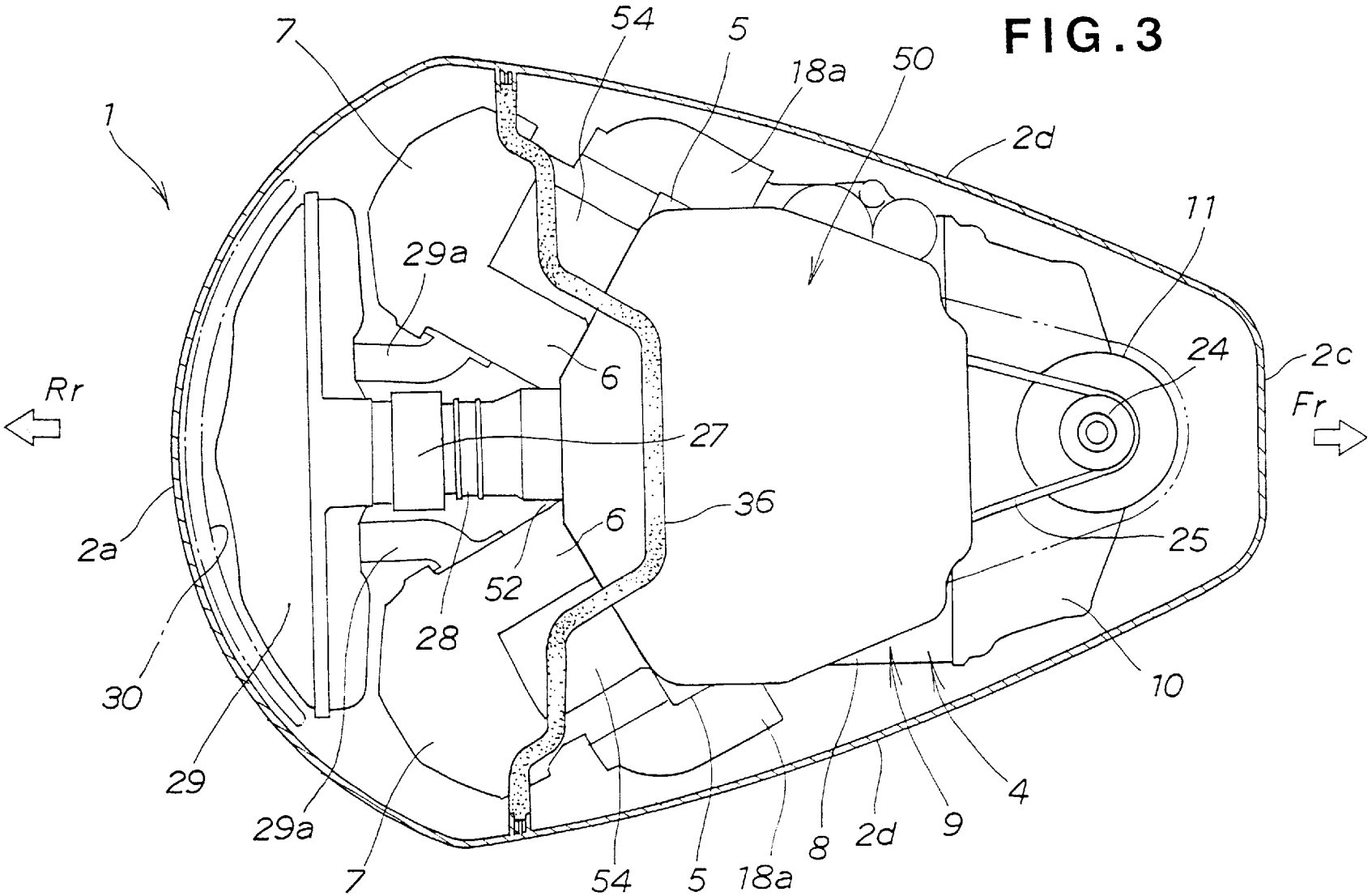
FIG. 3 is a horizontal sectional view of an upper portion of the outboard motor in FIG. 1.

Referring to FIGS. 1 and 3, an outboard motor 1 of the present invention has an engine 4 housed in an engine room 3 defined by an engine cover 2 constituting the contour of the motor 1. The engine 4 is a V-engine in a plan view with two cylinder blocks 5 extending right and left in the rearward direction, forming an opening (See FIG. 3). Each cylinder block 5 has a plurality of generally horizontal cylinders 5*a* arranged in the vertical direction. A piston 5*b* is fitted into each cylinder 5*a*.

A cylinder head 6 is connected to the rear end of each cylinder block 5. A cylinder head cover 7 is connected to the rear end of the cylinder head 6. A plurality of combustion chambers communicating with the horizontal cylinders 5*a* are formed between the cylinder head 6 and the cylinder block 5.

The cylinder blocks 5 integrally have a skirt 8 in the front portion. The skirt 8 houses a crankshaft 8*a* extending in the vertical direction. The cylinder blocks 5 together with the skirt 8 constitute an engine block 9.

The skirt 8 is connected at its front end (in the forward portion of the outboard motor) to a crankcase 10. A generator 11 is mounted on an upper front part of the crankcase 10.

A bottom block 12 of the engine 4 is supported on a mounting case 14 provided inside an under cover 13. The lower end 8*b* of the crankshaft 8*a* extends vertically downwards below the under cover 13 and is connected to the top end of a drive shaft 15 extending vertically through an extension case not shown. The lower end of the drive shaft 15 is connected to a gear box not shown for driving a screw.

In the figure, reference numeral 16 denotes an oil pan provided below the bottom block 12, 17 denotes a stern bracket for mounting the outboard motor to a stern, and 17*a* denotes a tilt shaft for supporting the outboard motor rotatably.

An exhaust pipe 18 is provided on the side of the cylinder head 6, extending downwards. The top end of the crankshaft 8*a* projects from the top surface of the crankcase 10 of the engine block 9. To the top end, a camshaft drive pulley 19 for driving a camshaft 37 is fixed. A camshaft driven pulley 20 is provided above the cylinder head 6. A timing belt 22 is wound around the drive pulley 19 and the driven pulley 20 through a middle pulley 21.

Rotation of the crankshaft 8*a* causes the camshaft 37 to rotate through the drive pulley 19, belt 22 and driven pulley 20.

Above the drive pulley 19, a generator drive pulley 23 for driving the generator 11 is fixed to the upper end of the crankshaft 8*a*. The drive pulley 23 is connected to a generator pulley 24 provided above the generator 11 through a belt 25. The generator 11 is driven through the rotation of the crankshaft 8*a*. Above the generator pulley 24, a belt cover 26 is provided.

The intake silencer 50 according to the present invention is arranged between a transmission system comprising the belt and pulleys 19 to 23, and an upper cover 2*b* of the engine cover 2.

The intake silencer 50 has an expansion chamber 51 inside and also has two inlets 54, 54 and one outlet 52 (See FIG. 2) to be described later. The intake silencer 50 is connected at the outlet 52 to a throttle body 27 via a grommet 28. The throttle body 27 communicates with an intake manifold 29 to distribute and supply fuel to the combustion chambers 5*c* as will be described later.

The engine cover 2 has a rear cover 2*a*, the upper cover 2*b*, a front cover 2*c* and right and left covers 2*d*, 2*d* (see FIG. 3). The lower end of the engine cover 2 is put on the top end of the under cover 13 to be joined. The engine cover 2 is formed with a recess 2*e* in a rear top surface. The recess 2*e* has an air inlet opening 2*f* for letting air in. The air inlet opening 2*f* lies in the same plane and communicates with an upper end opening 30*a* of an air intake guide 30 provided between the inside of the rear cover 2*a* of the engine cover 2 and the rear surface (outer surface) of the intake manifold 29. A lower end opening 30*b* of the intake guide 30 communicates with a rear portion of the engine room 3. The upper part of the recess 2*e* including the air inlet opening 2*f* is covered with a top cover 31.

The front cover 2*c* of the engine cover 2 has a labyrinth passage 33 configured to prevent water invasion by means of an upper and lower vertical walls spaced back and forth. A front lower part of the front cover 2*c* formed with the labyrinth passage 33 is covered by a front cover 34 including a plurality of air inlet slits 35. An upper front part of the front cover 2*c* is formed with a recess 2*g*. The recess 2*g* has an air inlet opening 2*h*. Air enters from the slits 35 in the front cover 34, passes through the labyrinth passage 33 to be introduced into the space below the generator and is further taken in through the upper openings 2*h*, 26*a* to be supplied to the generator 11, thereby cooling it.

Figure 2:
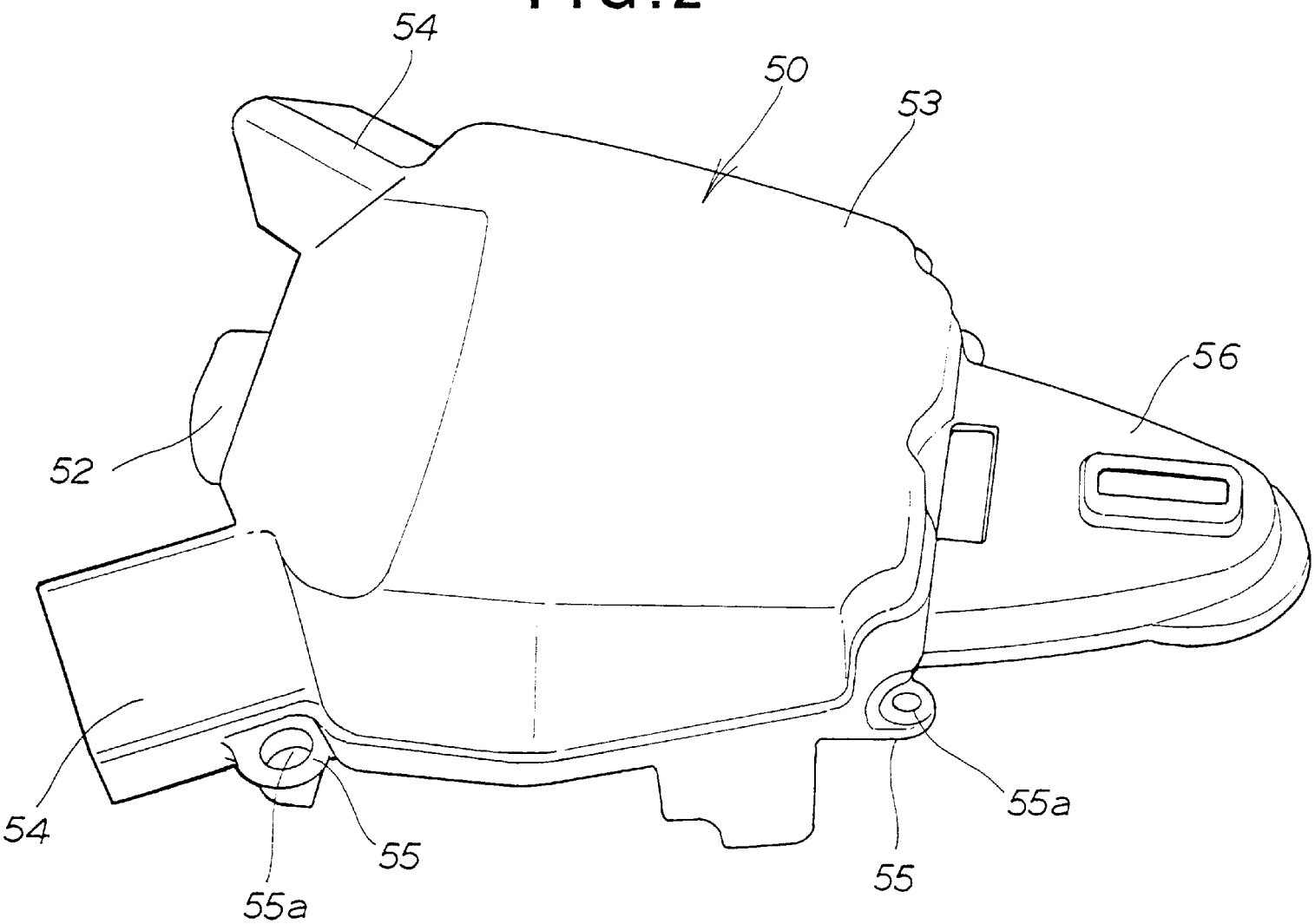
FIG. 2 is a perspective view of an intake silencer as shown in FIG. 1.

FIG. 2 shows on an enlarged scale the intake silencer 50 of FIG. 1. The intake silencer 50 has a body 53 with a dimension larger in the lateral direction (in the width direction of the outboard motor) in this embodiment. The body 53 has the expansion chamber 51 inside as shown in FIG. 1. The body 53 also has on the right and left in the rear thereof two inlets 54, 54 projecting rearwards in obliquely outward directions in a symmetrical relationship. The outlet 52 as illustrated in FIG. 1 is positioned between the two inlets 54, 54 and is arranged to project rearwards.

Figure 5:
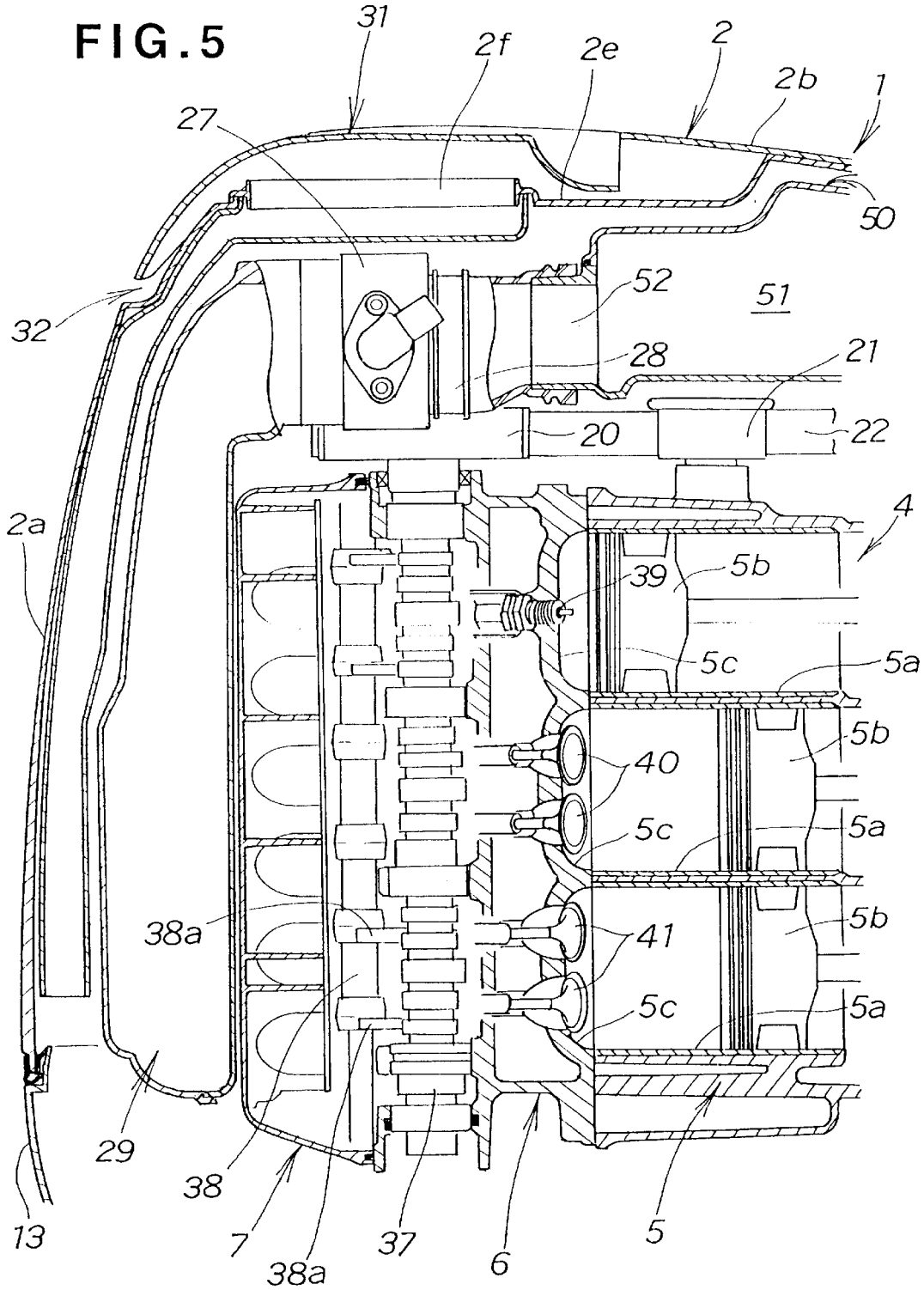
FIG. 5 is a sectional view taken along line 5—5 in FIG. 4.

A top wall of the body 53 of the intake silencer 50 is configured to be substantially flat as shown in FIG. 1 and FIG. 5 to be described later, so that the intake silencer 50 has a smaller height, thereby reducing the height of the outboard motor.

The body 53 has a plurality of mounting stays 55 having respective mounting holes 55*a* in the four peripheral corners. The body 53 also has at its front an extension 56 constituting part of the belt cover 26 as shown in FIG. 1.

FIG. 3 is a horizontal cross-sectional view of an upper part of the outboard motor as shown in FIG. 1.

The inlets 54, 54 on the right and left of the intake silencer 50 are positioned above the V cylinder heads 6, 6 extending rearwards Rr of the outboard motor 1.

The outlet 52 positioned between the right and left inlets 54, 54 is connected to the throttle body 27 via the grommet 28. The throttle body 27 is connected to an inlet of the intake manifold 29. The intake manifold 29 has six intake pipes 29*a* (only two shown in FIG. 3) extending from the right and left of a recessed surface of the front part thereof, to supply fuel to the combustion chambers 5*c* (See FIG. 1) of the cylinder heads 6, 6. On the outer side of each cylinder head 6 are provided a plurality of exhaust manifolds 18*a* which are connected to the exhaust pipe 18 as shown in FIG. 1.

In the figure, reference numeral 36 denotes a wall means formed with material such as rubber providing sealing for partitioning the engine room 3 into the front and rear portions.

Figure 4:
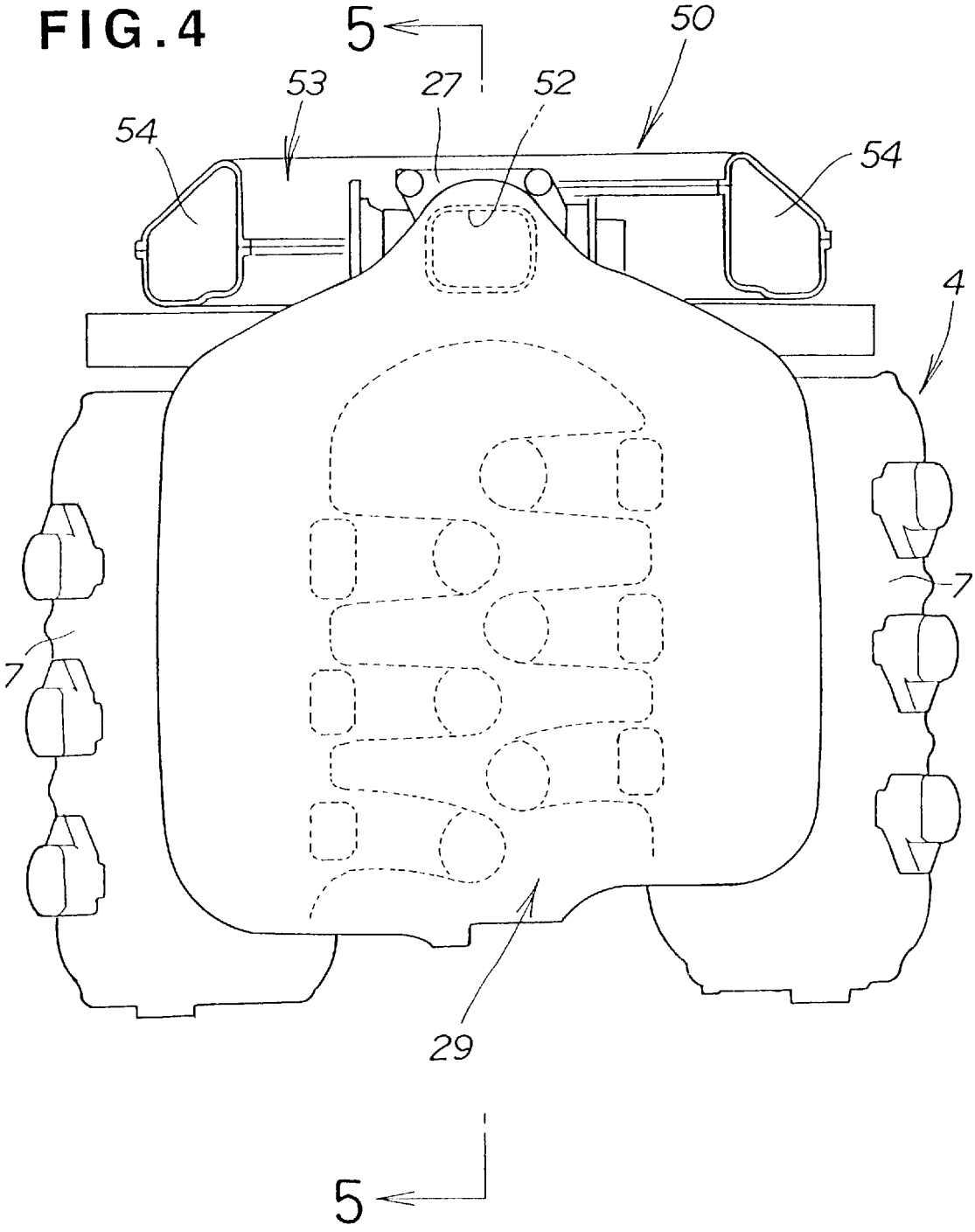
FIG. 4 is a rear view of the outboard motor in FIG. 3 with an engine cover omitted, showing the relationships in height between the intake silencer, cylinder head covers, and an intake manifold.

FIG. 4 shows the intake manifold 29 from the rear view of the outboard motor as shown in FIG. 3 with the engine cover omitted for convenience in description.

The intake manifold 29 is arranged rearwards of the right and left cylinder head covers 7, 7. The intake silencer 50 is arranged above the engine block of the engine 4. The inlets 54, 54 of the intake silencer 50 open in the same direction as the direction of the cylinder heads 6, 6 (cylinder head covers 7, 7) extending in the rearward direction.

In FIG. 5, the engine 4 as shown in this embodiment is a V-6 engine with three cylinders 5*a*, 5*a*, 5*a* arranged vertically. In the figure, an ignition plug 39 is shown in the uppermost combustion chamber 5*c*. Two intake valves 40, 40 are shown in the middle combustion chamber 5*c*. Two exhaust valves 41, 41 are shown in the lowermost combustion chamber 5*c*. The camshaft 37 extends vertically through the cylinder head 6. The top end of the camshaft 37 is connected to the camshaft pulley 20. The camshaft 37 is rotated through the rotation of the crankshaft 8*a* as shown in FIG. 1. The rotation of the camshaft 37 causes cams to move a plurality of valve rocker arms 38*a* supported on rocker arm shafts 38, thereby opening or closing the intake and exhaust valves 40, 41. The outside of the camshaft 37 and the valve rocker arm shafts 38 are covered with the cylinder head cover 7.

Obviously, various minor changes and modifications of the present invention are possible in the light of the above teaching. It is therefore to be understood that within the scope of the appended claims, the invention may be practiced otherwise than as specifically described above.

What is claimed is:

1. An outboard motor comprising:

a V engine arranged in a horizontal direction, the engine having an engine block provided with two cylinder blocks extending in a V configuration and forming therebetween an opening which opens to the rear of the outboard motor, a skirt integrally formed with the cylinder blocks and housing a crankshaft arranged vertically, and two cylinder heads provided on ends of the cylinder blocks to define a plurality of combustion chambers; and an intake silencer having two inlets positioned above the cylinder heads and forming an opening therebetween which opens rearwards of the outboard motor for taking air in, and one outlet positioned between the two inlets for letting the inlet air out to supply it to the combustion chambers.

2. An outboard motor according to claim 1; further comprising a transmission system for transmitting a drive force from the crankshaft to a camshaft for opening or closing intake valves and exhaust valves provided in the combustion chambers, the transmission system being provided between the engine block and the intake silencer.

3. An outboard motor according to claim 2; further comprising a throttle body connected to the outlet of the intake silencer and arranged between the cylinder and above the camshaft.

4. An outboard motor according to claim 3; further comprising a grommet for connecting the outlet of the intake silencer to the throttle body.

5. An outboard motor according to claim 2; wherein the transmission system has a driving pulley driven by the crankshaft, a driven pulley connected to the camshaft, and a belt entrained around the driving and driven pulleys.

6. An outboard motor according to claim 5; further comprising a second driven pulley driven by the crankshaft and a second belt entrained around the driving pulley and the second driven pulley; wherein the intake silencer has a body with an extension portion serving as a belt cover for covering a portion of the second belt.

7. An outboard motor according to claim 1; wherein the intake silencer has a body with a substantially flat top wall.

8. An outboard motor comprising: a engine cover defining an engine room and having an air intake opening; an engine disposed in the engine room; an air intake guide disposed within the engine cover and having one end communicating with the air intake opening of the engine cover and another end opening into the engine room; an intake silencer comprising at least one inlet positioned above the engine and facing in a rearward direction of the outboard motor for taking air in, and an outlet positioned in the rearward direction of the engine; and a throttle body connected to the outlet for supplying the inlet air to the engine.

9. An outboard motor according to claim 8; wherein the engine has two cylinder blocks arranged to form an opening which opens in the rearward direction of the outboard motor.

10. An outboard motor according to claim 9; wherein the intake silencer has an inlet for each of the two cylinder blocks, the inlets being positioned above the cylinder blocks and oriented to form an opening in the rearward direction of the outboard motor, and the outlet is positioned between the two inlets.

11. An outboard motor according to claim 8; wherein the air intake opening is provided in an upper portion of the engine cover, and the air intake guide has a first opening connected to the air intake opening, a second opening in the engine room for discharging air, and a main body connecting the first and second openings and extending downward from the air intake opening into the engine room.

12. An outboard motor according to claim 11; wherein the main body of the air intake guide has an upper portion in contact with an inner surface of the engine cover and a lower portion spaced from the inner surface of the engine cover.

13. An outboard motor according to claim 8; wherein the engine cover has a recessed portion in which the air intake opening is formed; and further comprising a top cover member covering the recessed portion and having one or more openings in communication with the air intake opening.

14. An outboard motor comprising: a V-type engine having a plurality of cylinder blocks arranged to form a V-shaped opening which opens in a rearward direction of the outboard motor, a skirt integrally formed with the cylinder blocks for housing a crankshaft therein, and a plurality of cylinder heads each provided at an end of a respective cylinder block to jointly define therewith a plurality of combustion chambers; and an intake silencer comprising an inlet for each of the cylinder blocks, the inlets being positioned above the cylinder heads and oriented to form an opening in the rearward direction of the outboard motor for taking in air, and an outlet positioned between two of the inlets for letting out the inlet air to supply it to the combustion chambers.

15. An outboard motor according to claim 14; further comprising a transmission system for transmitting a drive force from the crankshaft to a camshaft for opening or closing intake valves and exhaust valves provided in the combustion chambers, the transmission system being provided between the engine and the intake silencer.

16. An outboard motor according to claim 15; wherein the transmission system has a driving pulley driven by the crankshaft, a driven pulley connected to the camshaft, and a belt entrained around the driving and driven pulleys.

17. An outboard motor according to claim 16; further comprising a second driven pulley driven by the crankshaft and a second belt entrained around the driving pulley and the second driven pulley; wherein the intake silencer has a body with an extension portion serving as a belt cover for covering a portion of the second belt.

18. An outboard motor according to claim 15; further comprising a throttle body connected to the outlet of the intake silencer and arranged above the camshaft.

19. An outboard motor according to claim 18; further comprising a grommet for connecting the outlet of the intake silencer to the throttle body.

20. An outboard motor according to claim 14; wherein the intake silencer has a body with a substantially flat top wall.

* * * * *